United States Patent [19]

Grubbs et al.

[11] Patent Number: 5,018,540

[45] Date of Patent: May 28, 1991

[54] PROCESS FOR REMOVAL OF BASIC MATERIALS

[75] Inventors: Harvey J. Grubbs, Mechanicsville; Ravi Prasad; Tony M. Howell, both of Midlothian, all of Va.

[73] Assignee: Philip Morris Incorporated, New York, N.Y.

[21] Appl. No.: 122,761

[22] Filed: Nov. 19, 1987

Related U.S. Application Data

[63] Continuation-in-part of Ser. No. 947,102, Dec. 29, 1986, abandoned.

[51] Int. Cl.[5] ..... A24B 15/24; A24B 15/26

[52] U.S. Cl. ..... 131/297; 131/298; 131/352; 131/356; 131/310; 426/427; 426/428; 423/658.5

[58] Field of Search ..... 131/310, 352, 356, 297, 131/298; 426/427, 428; 423/658.5; 542/282

[56] References Cited

U.S. PATENT DOCUMENTS

| | | |
|---|---|---|
| 283,622 | 8/1882 | Liebrich et al. . |
| 678,362 | 7/1901 | Froehling . |
| 802,487 | 10/1905 | Wimmer . |
| 896,124 | 8/1908 | Lindenberger et al. . |
| 1,196,184 | 8/1916 | Villiers-Stuart . |
| 1,294,310 | 2/1919 | Sayre et al. . |
| 1,577,768 | 3/1926 | Smith . |
| 1,671,259 | 5/1928 | Schloesing . |
| 1,813,833 | 7/1931 | Andrews . |

(List continued on next page.)

FOREIGN PATENT DOCUMENTS

| | | |
|---|---|---|
| 1130988 | 7/1982 | Canada . |
| 0011368 | 5/1980 | European Pat. Off. . |
| 0088405 | 9/1983 | European Pat. Off. . |
| 0141097 | 5/1985 | European Pat. Off. . |
| 862612 | 11/1952 | Fed. Rep. of Germany . |
| 2059077 | 6/1972 | Fed. Rep. of Germany . |
| 3716689 | 1/1988 | Fed. Rep. of Germany . |
| 397021 | 2/1909 | France . |
| 2106252 | 4/1972 | France . |
| 54-52798 | 4/1979 | Japan . |
| 82835 | 2/1987 | Luxembourg . |
| 2111371 | 3/1931 | United Kingdom . |
| 1288168 | 9/1972 | United Kingdom . |
| 345249 | 7/1983 | United Kingdom . |

OTHER PUBLICATIONS

L. N. Luganskaja, E. B. Kransnokutskaj and L. B. Jasinskaja, "The Use of Tobacco Dust Extract for Aromatizing Purposes", *Tabak, SSSR*, 1, pp. 30–33 (1967).

W. R. Harvey, H. M. Stahrand, W. C. Smith, "Automated Determination of Reducing Sugars and Nicotine (List continued on next page.)

*Primary Examiner*—V. Millin

*Attorney, Agent, or Firm*—Thomas L. Secrest; James E. Schardt

[57] ABSTRACT

A process is provided for the selective removal of basic materials from plant products, in particular, for removing nicotine from tobacco without materially affecting the content of the other components of the tobacco. Tobacco is traversed with a solvent at high pressure and in a physical state which is either a liquid at a pressure of from about 500–300 atmospheres or a supercritical fluid wherein nicotine and the other components dissolve in the solvent. As the single means of removing substances from the solvent, the solvent is then passed through an acid-containing trap where the solvent is essentially freed of nicotine. The solvent, depleted of nicotine and enriched in the other components, is then recycled to the tobacco to reextract nicotine. In addition, the tobacco may be pretreated with a chemical base which does not substantially react with the tobacco components under ambient conditions and which are not necessarily affected by the process conditions but are nonetheless effective in increasing the amount of nicotine which can be extracted by the process of this invention. Pretreatment of the tobacco with a chemical base neutralizes nicotine salts and permits the extraction process to be carried out under milder conditions.

60 Claims, 1 Drawing Sheet

U.S. PATENT DOCUMENTS 1,823,554 9/1931 Mewborne .
1,859,379 5/1932 Chesley .
1,984,445 12/1934 Wagner .
2,048,624 7/1936 Roselius .
2,128,043 8/1938 Garner .
2,162,738 6/1939 McCoy .
2,227,863 1/1941 Rhodes .
2,286,639 6/1942 Ott .
2,582,075 1/1952 Severi .
2,805,667 9/1957 von Bethmann .
2,822,306 2/1958 Thienemann et al. .
3,046,997 7/1962 Hind .
3,096,773 7/1963 Neukomm et al. .
3,110,315 11/1963 Lendvai .
3,139,435 6/1964 Staley et al. .
3,151,118 9/1964 Moser .
3,390,685 7/1968 von Bethmann et al. .
3,396,735 8/1968 von Bethmann et al. .
3,424,171 1/1969 Rooker .
3,482,328 12/1969 Larkham .
3,612,066 10/1971 Jones et al. .
3,742,962 7/1973 Brochot .
3,771,533 11/1973 Armstrong et al. .
3,821,960 7/1974 Egri .
3,874,392 4/1975 DeBrunn et al. .
4,068,671 1/1978 Casey .
4,123,592 10/1978 Rainer et al. .
4,153,063 5/1979 Roselius et al. .
4,215,706 8/1980 Larson et al. .
4,243,056 1/1981 de la Burde .
4,248,252 2/1981 Lendvay et al. .
4,506,682 3/1985 Muller .
4,548,755 10/1985 Stahl et al. .
4,561,452 12/1985 Gahrs .
4,607,646 8/1986 Lill et al. .
4,628,947 12/1986 Driscoll et al. .
4,677,994 7/1987 Denier et al. .
4,700,722 10/1987 Korte et al. .
4,714,617 12/1987 Gährs .
4,727,889 3/1988 Niven, Jr. et al. .

OTHER PUBLICATIONS

Alkaloids on the Same Extract of Tobacco", Tobacco Science, 168, pp. 48–50 (1969).

L. N. Luganskaja, "On the Aromatization of Tobacco", *Trav. Inst. Rech.*, Sci., Kransnodor, 3, pp. 199–205 (1967) as cited in Tobacco Abstracts, 12, pp. 394–395 (1968).

P. Hubert and O. G. Vitzhthum, "Fluid Extraction of Hops, Spices and Tobacco with Supercritical Gases", *Angewandte Chemie, Int. Ed. Engl.*, 17, pp. 710–715 (1978).

D. F. Williams, "Extraction with Supercritical Gases", Review Article No. 5, *Chemical Engineering Science*, 36, pp. 1769–1788, 1781 (1981).

PROCESS FOR REMOVAL OF BASIC MATERIALS

This is a continuation-in-part of application Ser. No. 947,102 filed Dec. 29, 1986 now abandoned.

FIELD OF THE INVENTION

This invention relates to extraction procedures and is particularly directed to a process for the selective removal of basic materials from plant products. The invention may be used for the selective extraction of particular substances from a great variety of plant products. However, it is particularly applicable and will therefore be described in connection with the extraction of nicotine from tobacco.

BACKGROUND OF THE INVENTION

Various processes have been proposed for the removal of nicotine from tobacco. Most of these processes, however, are not sufficiently selective for nicotine and remove other ingredients from the tobacco. Removal of these other ingredients adversely affects the desirable flavor and aroma properties of the tobacco. Other processes generally have been found to be limited in their scope and effectiveness and are often complex and expensive to carry out.

Nicotine has been extracted from tobacco using organic solvents with and without neutralization of the nicotine salt. Representative of such processes are those disclosed in U.S. Pat. Nos. 678,362 (Froehling), 1,196,184 (Villiers-Stuart), 2,048,624 (Roselius), 2,128,043 (Garner), 2,227,863 (Rhodes) and 3,096,773 (Neukomm et al.). Nicotine has also been extracted from tobacco with aqueous solutions with and without neutralization of the nicotine salt. Representative of such processes are those disclosed in U.S. Pat. Nos. 2,822,306 (Thienemann et al.), 2,582,075 (Severi) and 3,874,392 (De Brunn et al.). Nicotine has been separated from solutions of tobacco extracts and the nicotine depleted solvent returned to the tobacco. Representative of such processes are those disclosed in U.S. Pat. Nos. 283,622 (Liebreich et al.), 802,487 (Wimmer), 2,805,667 (von Bethmann), 3,046,997 (Hind), and 3,139,435 (Staley et al.). Nicotine has also been separated from solutions of tobacco extracts and the depleted solvent saturated with the other components recycled to the extraction vessel. Representative of such processes are those disclosed in U.S. Pat. Nos. 1,294,310 (Sayre et al.), 1,577,768 (Smith), 1,813,833 (Andrews), 3,396,735 (von Bethmann) and 3,612,066 (Jones).

Nicotine has been transferred from tobacco to a substrate without the use of a solvent by contacting the tobacco intimately with a substrate which has been treated with an acid as disclosed in U.S. Pat. No. 4,215,706 (Larson). This process may be carried out with or without heat.

U.S. Pat. No. 4,153,063 (Roselius) discloses a process for removing nicotine from tobacco in which tobacco is contacted with an extraction solvent in a supercritical state. In a single step extraction process, moist tobacco is extracted with a solvent in a supercritical state. Thereafter the solvent is evaporated. Because aroma components are also removed along with nicotine in this single step extraction process, a multi-step process has been suggested. In the first step, dry tobacco is extracted with a solvent in the supercritical state to remove the aroma components. In the second step, the tobacco is moistened and again extracted with a solvent in the supercritical state to remove nicotine which is separated by either evaporating the solvent, contacting the solvent in a separate vessel with an acid, or adsorbing the nicotine on an active carbon column. In the third step, the stored aroma components from the first step are redissolved in a supercritical solvent and returned to the tobacco. This multi-step extraction process is expensive and time consuming. In addition, the prolonged handling of the aroma components may adversely affect their properties.

SUMMARY OF THE INVENTION

This invention provides a process for removing nicotine from tobacco without also removing the desirable aroma generating components. Tobacco is extracted with a solvent either in the super-critical state or in the liquid state. Thereafter, nicotine is selectively removed from the enriched solvent by passing the solvent through a trap containing a non-volatile acid which is not soluble in the extraction solvent. The trap may be contained on a support medium. The solvent, depleted of nicotine and enriched in the other components, is then recycled to the tobacco to extract nicotine again.

Alternatively, the tobacco may be pretreated with a chemically basic (alkaline) compound which does not significantly react with the tobacco components under ambient conditions but rather is effective in increasing the amount of extractable nicotine under the conditions of the extraction process. Pretreatment of the tobacco with a basic compound neutralizes nicotine salts and permits the extraction process to be carried out under milder conditions.

It is an object of this invention to provide a process for selectively reducing the level of nicotine in tobacco using a single stage extraction process with or without separate entrapment vessels.

It is another object of this invention to provide a process for the migration of nicotine from one tobacco substrate (leaf material or reconstituted leaf) to a second tobacco substrate (leaf material, reconstituted leaf material or tobacco stems) or to a non-tobacco substrate.

It is another object of this invention to provide a process for the migration of flavor and aroma components (with or without nicotine) from one tobacco substrate (leaf material or reconstituted leaf) to a second tobacco substrate (leaf material, reconstituted leaf material or tobacco stems) or to a non-tobacco substrate.

It is another object of this invention to provide a process for the attenuation or removal of flavor or aroma substances.

It is a further object of this invention to provide a process using adsorption media (full flavor tobacco filler, reconstituted leaf materials, tobacco stems, cotton cloth, cellulose, carbon, cocoa shells, other plant byproducts, porous ceramic, porous metal, etc.) to facilitate the selective removal of nicotine.

It is a further object of this invention to provide a process using aqueous absorption media (water, aqueous acid, aqueous salt, etc.) to facilitate the selective removal of nicotine.

It is a further object of this invention to provide a process for the extraction of nicotine from tobacco under relatively mild conditions.

These and other objects and advantages of the invention may be seen in the following description.

DETAILED DESCRIPTION OF THE INVENTION

Figure 1:
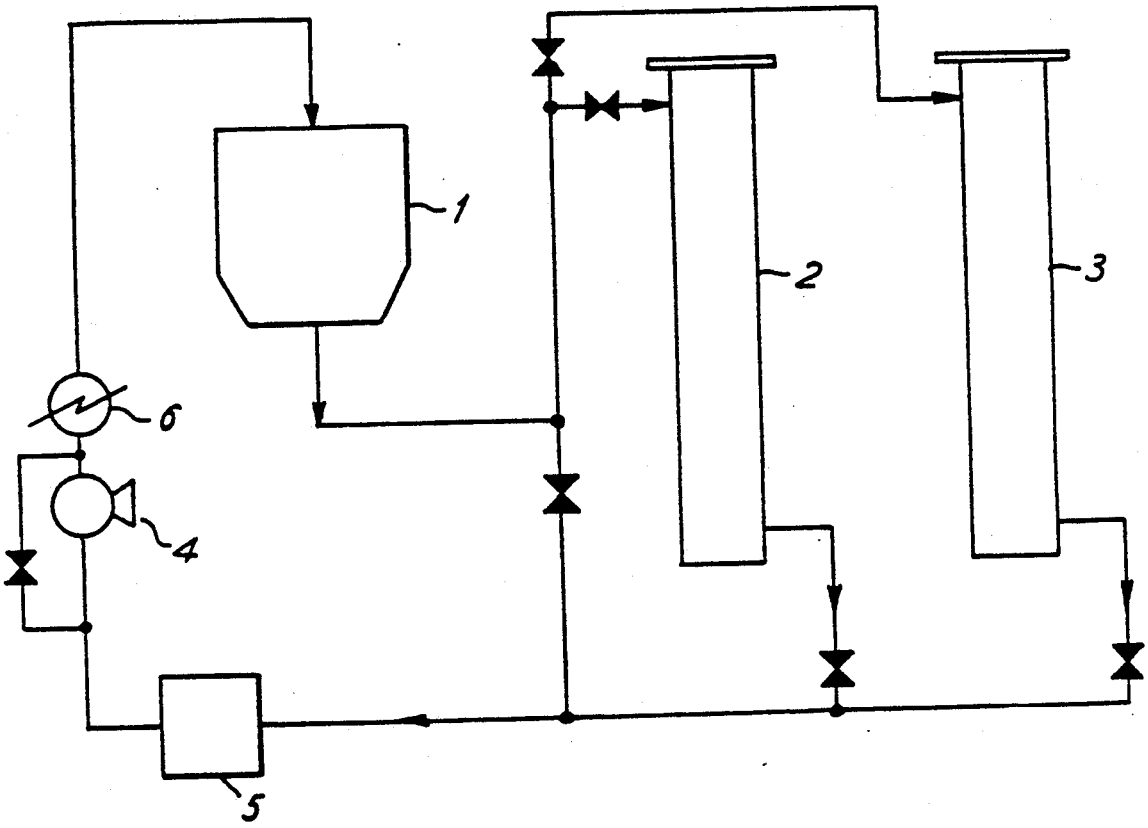
FIG. 1 illustrates the apparatus for removing basic materials.

FIG. 1 illustrates one preferred apparatus for removing nicotine from tobacco and tobacco blends. Extraction vessel 1 is filled with a sample of tobacco and entrapment vessels 2 and 3 are filled with an acid impregnated support medium or water, preferably containing some acid. An extraction solvent is supplied to vessel 1 which is connected to a pump 4 and a mass flow meter 5. The pressure in the vessel is controlled by means of a fill pump (not shown) and the temperature is controlled by means of heat exchanger 6. The extraction solvent enters the top of the extraction vessel, passes downwardly through the sample and leaves at the bottom of the vessel. In passing through the sample, the extraction solvent becomes enriched with components of the sample. The solvent is then circulated through either trap 2 or trap 3, or both, again being introduced from the top, and then passing downwardly and exiting at the bottom. The entrapment time may be split between traps 2 and 3. In passing through the trap or traps, the nicotine in the solvent reacts with the acid and becomes trapped therein while the remaining aroma components in the solvent pass through the trap or traps freely. The solvent, depleted of nicotine and enriched in the other components, is then returned into the cycle by recirculating it to the extraction vessel.

The extraction vessel is preferably designed for radial flow or for axial flow of solvent. The entrapment vessels are preferrably both designed for radial flow or axial flow but need not be of the same design as the extraction vessel. A radial flow of solvent will minimize compaction of solid material in a vessel and may allow for lower pressure drops within each vessel. Persons skilled in the art will recognize that many directions of flow will be effective, e.g., flow from bottom to top, top to bottom or inward or outward radially in each vessel. Persons skilled in the art will also recognize that the pump can be placed on any of several lines in the system.

An especially preferred procedure makes it possible to contain both the tobacco sample and a relatively small volume of entrapment material in the same extraction vessel. In this procedure, the entrapment material is placed in the bottom portion of the extraction vessel, a porous plate is placed on top of the trap and the tobacco is loaded into the extraction vessel on top of and supported by the porous plate. The entrapment vessels 2 and 3 are removed from the flow system by valve adjustment. The extraction of the tobacco sample is then carried out as before by introducing the solvent into the top of the extraction vessel and passing it downwardly through the sample until it exits at the bottom of the vessel.

One advantage of this process is that no additional vessel is necessary to contain a relatively large quantity of adsorption material to trap the nicotine. The ability to carry out the extraction in a single vessel results in a more economical process for the above reasons and also because the solvent to tobacco ratio can be significantly lowered. The ability to use less solvent also results in less degradation and loss of the aroma producing components and consequently in an improved tobacco product.

In another embodiment of this invention, the tobacco may be pretreated with a chemically basic compound which does not significantly react with the tobacco components under ambient conditions but are nonetheless effective in increasing the amount of nicotine which can be extracted by the process of this invention. Nicotine is thus liberated from its salts and immediately taken up in the extraction solvent before other base induced chemistry is initiated within the tobacco. Since the solubility of the nicotine free base is generally higher than that of the nicotine salts in the extraction solvents of choice, the extraction process may be carried out under milder conditions. Pretreatment can include spraying or soaking the tobacco with the basic compound or a suitable solution thereof.

Persons skilled in the art will recognize that the said chemically basic compounds include those which are not necessarily affected by the process conditions but are nonetheless effective in increasing the amount of nicotine which can be extracted by the process of this invention.

A number of extraction solvents having solvent capacity for nicotine in both their liquid and gaseous phases can be employed to reduce the nicotine content of tobacco. The liquids of the present invention are at a pressure of from about 50 to 300 atmospheres. Carbon dioxide in the supercritical state is the preferred solvent in this invention. Other useful solvents include, for example, halogenated hydrocarbons including up to about 4 carbon atoms such as $CF_4$, $CHF_3CClF_3$, $CBrF_3$, $CF_2{=}CH_2$, $CF_3{-}CF_2CF_3$, $CHClF_2$, $CCl_2F_2$, $CHCl_2F$, $CCl_3F$, $CBrF_3$, $CFCl{=}CF_2$, $CH_3{-}CF_3$, octafuorocyclobutane and hydrocarbons including up to about 5 carbon atoms such as propane, butane, pentane; other useful solvents include $N_2O$, $SF_6$ and argon. Mixtures of solvents or additives or co-solvents may be used to obtain improved solvent characteristics. In addition, water, ammonia, or aqueous ammonia can be mixed with the extraction solvent to obtain improved solvent characteristics. Carbon dioxide is the preferred solvent because it is a naturally occurring compound and leaves no non-tobacco residue in the extracted tobacco.

A solvent in the supercritical state is a solvent in the gas phase at a sufficiently high temperature so that it cannot be liquified by an increase in pressure. A solvent in the subcritical state is a solvent which can be liquified by an increase in pressure.

Supercritical carbon dioxide is carbon dioxide which is above its critical temperature, i.e., above 31.3° C., and above its critical pressure, i.e., above about 70 atmospheres. Extraction with carbon dioxide in the supercritical state is carried out at a pressure in the range of from about 70 to about 1500 atmospheres and at a temperature in the range of from just above the critical temperature to about 120° C. The range of temperature and pressure for the supercritical state of other useful solvents are of generally the same order of magnitude.

The preferred acids for use in this invention are acids which are non-volatile and non-soluble in the extraction solvent under the conditions of the extraction. Useful acids are sulfuric, phosphoric and nitric. Other useful acids include polycarboxylic acids such as tartaric, citric, malic, malonic, succinic and glutamic. Monovalent salts, such as the alkali metal salts, of the above acids are generally preferred because these salts are less volatile and less soluble in the solvent. A preferred salt of an acid is monopotassium citric acid. Monoammonium and diammonium salts of the above acids may also be used. Polyvalent salts of the above acids are also useful but are less efficient in trapping nicotine.

The acid in the trap is preferably, though not necessarily, in contact with a support medium, which does not impede the flow of the solvent. The acid may be impregnated on, deposited on, or otherwise in contact with the support medium. Useful support media are carbon, tobacco filler, reconstituted leaf materials, tobacco stems, cotton cloth, cellulose, cocoa shells, other plant by-products, porous ceramic, porous metal and the like. The tobacco stems may be long stems, cut and rolled, shredded, expanded, treated or untreated. Especially preferred support media are shredded tobacco stems and cocoa shells.

The support medium for the acid may even be water, as in the case where the solvent is bubbled through an aqueous solution of the acid. A preferred trap material is an aqueous solution of citric acid. An especially preferred trap material is an aqueous solution of monopotassium citrate.

The ratio of acid to nicotine may range from about 10:1 to about 1:1 and preferably from about 4.5:1 to 1.5:1.

The concentration of the acid in the support medium is not critical. The concentration should be high enough to minimize the volume of support medium required within the vessel but low enough not to impede the flow characteristics of the solvent through the support medium. The concentration of acid in the support medium may vary but in the case of tobacco stems the concentration generally ranges from about 5% by weight to about 40% by weight and preferably is about 15% by weight. Higher acid concentrations, i.e., saturated or crystalline forms are not excluded.

The chemical bases for use in this invention for pretreating tobacco are bases which do not significantly react with the tobacco components under ambient conditions. Chemical bases which do significantly react with the tobacco components under ambient conditions may initiate base catalyzed chemistry in the tobacco, blackening the tobacco and otherwise adversely affecting its smoking characteristics. Rather, the preferred base is one which is effective in increasing the amount of extracted nicotine without excessively increasing the extraction of flavor constituents. Such a base may react with the components in the tobacco under the conditions of the extraction process. In this way, nicotine is liberated from its salts and immediately taken up in the extraction solvent before other base induced chemistry is initiated within the tobacco. Since the solubility of the nicotine free base is higher than that of the nicotine salts in the extraction solvent, one may carry out the extraction process under milder conditions. In this way the quality of the subjective smoking characteristics is preserved. Chemical bases which do not significantly react under ambient conditions and which are not necessarily affected by the process conditions but are nonetheless effective in increasing the amount of nicotine which can be extracted by the process of this invention include ammonium bicarbonate, sodium or potassium carbonate or bicarbonate, glycosylamines, N-glycosides of aldoses, N-glycosides of ketoses and the like.

Other chemical bases are useful in practicing this invention, including ammonia, aqueous ammonia, trimethyl amine and triethyl amine, which can be effective in increasing the amount of extractable nicotine under the extraction conditions, although some such compounds in some concentrations may adversely affect the subjective characteristics of the tobacco. In general, bases which liberate nicotine from its acid salts are effective in practicing this invention, especially bases with a $pK_a$ greater than about 7.2 and less than about 10. Combinations of suitable bases are also within the scope of the invention.

A glycosylamine useful in the present invention is illustrated by the following formula:

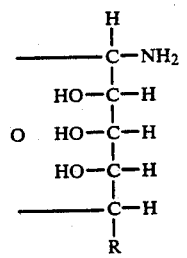

where R is a hydrogen, methyl or methylol substituent.

Illustrative of the invention glycosylamine compounds is 1-amino-1-deoxyglucose (R=CH20H). Other glycosylamine compounds include 1-amino-1-deoxymannose (mannosylamine), 1-amino-1-deoxyribose (ribosylamine), 1-amino-1-deoxygalactose (galactosylamine), 1-amino-1-deoxyrhamnose (rhamnosylamine), 1-amino-1-deoxyfucose (fucosylamine), 1-amino-1-deoxyxylose (xylosylamine), 1-amino-1-deoxyarabinose (arabinosylamine), 1-amino-1-deoxylyxose (lyxosylamine), and the like.

The glycosylamine compounds included in this invention are, in pure form, stable and odorless compounds at ambient temperatures. In addition, the glycosylamine compounds decompose at a relatively low pyrolysis temperature (e.g., 200°-300° C.) to release ammonia, pyrazine and related compounds.

Ammonia-derived glycosylamines with an unsubstituted amino-group (—$NH_2$) are more stable than glycosylamines in which the amino group is substituted (—NHR or $NR_2$) If the amino group is an amino acid structure, then there is a self-catalyzed Amadori Rearrangement, i.e., a conversion of N-glycoside of aldose sugar to an amine derivative of the corresponding ketose, in addition to other side-reactions which occur at room temperature.

Another preferred form of the invention includes pretreating tobacco by spraying it with an aqueous solution of ammonium bicarbonate. Ammonium bicarbonate is useful if applied at about 1% of the dry weight of tobacco (mass/mass) and can be applied at up to 3% of the dry weight of tobacco. The resulting tobacco, after extraction, is generally less harsh than non-pretreated tobacco.

Neutralization of nicotine salts may also be carried out by contemporaneously adding a source of base during the supercritical extraction such that neutralization and extraction of nicotine occur simultaneously and no significant base-induced chemistry within the tobacco is initiated.

In a typical example of the process of this invention, an acid-containing trap is prepared by impregnating an aqueous solution of an acid such as monopotassium citric acid into a support such as expanded tobacco stems. The entrapment material is then placed in an extraction vessel, a porous plate placed on top of the acid-containing trap material and the tobacco to be extracted is loaded on top of the plate. The vessel is charged with solvent, the pressure is brought to 260 atmospheres and the temperature is brought to 70° C.

The tobacco to be extracted is adjusted to contain an oven volatile content of about 25%. The percentage of oven volatiles (% OV) in the tobacco is a measure of the moisture content plus a minor fraction of other components and is determined as follows:

$$\% OV = \frac{\text{weight loss of sample after 3 hrs at 100° C.}}{\text{sample weight}}$$

The tobacco is then traversed with an extraction solvent such as carbon dioxide in the supercritical state, and nicotine and other components are dissolved in the extraction solvent. The enriched supercritical solvent is then passed through the acid containing trap wherein the solvent is freed of nicotine. The supercritical solvent, depleted of nicotine and enriched in other components, is then recycled to the tobacco. The aroma-generating components are extracted from the tobacco only during the initial stages of the cycle since the solvent rapidly becomes saturated with these components. Because nicotine is continuously removed from the solvent, upon recycling the solvent is able to extract additional amounts of nicotine from the tobacco.

The process is carried out until the desired level of nicotine reduction in the tobacco is achieved. Usually 30 to 60 minutes is sufficient. An advantage of this process is that principally the nicotine is removed from the supercritical solvent and the aroma-generating components are substantially preserved.

Valve and instrumentation hardware may be arranged to allow (a) by-pass of the $CO_2$ flow to all vessels, (b) $CO_2$ flow from an extraction vessel to any entrapment vessel, (c) $CO_2$ flow both upflow and downflow in any vessel, (d) faster turn-around time, (e) use of both large and small $CO_2$ fill pumps and (f) pressure drop instrumentation for up and down flow differential pressure measurement in the entrapment vessels. The flow of $CO_2$ is in the opposite direction from the force of gravity in the upflow mode and in the same direction in the downflow mode.

For better retention of tobacco subjective smoking characteristics, the extraction vessel may be by-passed during the $CO_2$ fill and heat period, and the $CO_2$ flow directed only through the entrapment vessels. Once extraction process conditions are reached, the $CO_2$ flow is then directed through the extraction vessel or vessels. Extraction process conditions are reached quickly (4–8 minutes). In an experiment using this process, the beginning of each extraction run was counted when process conditions were reached (temperature, pressure) and the end of each run was counted when the required amount of $CO_2$ mass (m/m, mass of extraction solvent-/mass of tobacco) had traversed the tobacco.

Table 1 illustrates the results of extraction runs carried out using carbon as an adsorbent support.

Full flavor American blend tobacco at 25% OV (oven volatiles) was extracted over a period of 30 minutes using activated carbon as an adsorbent (Run-16, Table 1). The nicotine content of the tobacco was reduced 97.2%. Tobacco flavor was improved, as judged by subjective tests, in comparison to tobacco subjected to longer extraction periods.

When activated carbon saturated with potassium citrate was used as the adsorbent support, the carbon to tobacco ratio was significantly reduced, from 2:1 for carbon alone, to 0.25:1. The level of nicotine extracted was slightly lower due to breakthrough of nicotine through the entrapment columns. The tobacco subjectives (aroma, flavor and other smoking characteristics) were very poor (Runs-17,-18, Table 1).

In an attempt to extract subjectives only, tobacco, without being premoistened, was extracted with supercritical $CO_2$ under control conditions (260 atmospheres, 70° C., 12% OV, 30 min, 150 m/m). Contrary to the published patent literature (U.S. Pat. No. 4,153,063, Roselius), 94.4% of the nicotine was removed from the tobacco (Run-21, Table 1).

Table 2 illustrates the results from extraction runs carried out using potassium-citrate treated stems as the adsorbent support.

The best subjectives overall in the experiments summarized in Table 2 were obtained when shredded stems were used as the adsorbent support at a stem to tobacco ratio of about 1:1 by weight and a potassium citrate to nicotine molar ratio of 8:1 (Run-41, Table 2). The entrapment material was divided equally between two entrapment columns. Subjective quality approached that of the unextracted control and 93.7% of the nicotine was removed from the tobacco. A one hour extraction period was used at a lower $CO_2$ flow rate in order to minimize compaction of the stems in the entrapment columns.

Table 2 also shows the following results:

Use of dual entrapment columns gives higher levels of nicotine removal than use of a single entrapment column containing the same amount of entrapment material.

An entrapment time split of 15 and 45 minutes or 20 and 40 minutes, in entrapment vessels 2 and 3, respectively, is preferred over a time split of 30 and 30 minutes (based on nicotine breakthrough profiles).

A high stems to tobacco ratio, e.g., in excess of about 2:1 gives a "stemmy" character to the extracted tobacco.

Predrying of the stems to maximize potassium citrate loading results in a toasted note. Use of stems, without predrying, gives a more acceptable product.

Maximum nicotine removal from full flavor tobacco requires (1) a high potassium citrate level on the stems, (2) a low level of background nicotine in the adsorbent support, and (3) use of dual entrapment columns.

Shredded stems are the preferred stem type for an adsorbent support. Use of cut and rolled stems probably results in a pressure drop problem and use of long stems results in poor nicotine extraction.

Table 3 shows the results from extraction runs using potassium citrate treated full flavor American blend tobacco as the adsorbent support.

Subjectives were judged good but nicotine removal was low, in the range of 83% to 88% (Table 3) due to the high level of nicotine already present on the adsorbent support. Higher nicotine removal levels probably require significantly higher potassium citrate loading.

High levels of full flavor tobacco subjectives were present in the $CO_2$ at the end of the extraction as evidenced by the waxy coating on the metal surfaces of the extraction/entrapment vessels.

Table 4 shows the results from extraction runs using non-tobacco adsorbent supports.

When potassium citrate treated pure 100% cotton fabric was used to remove nicotine from tobacco, subjectives were judged not as good, thin with slight mouthcoating, as with potassium citrate treated stems (Run-27, Table 4).

Use of potassium citrate treated pure alphacellulose gave a low removal of nicotine from tobacco, probably due to the non-uniform distribution of potassium citrate on the cellulose support. Subjectives were judged unacceptable, bittergreen, dry, and astringent (Run-32, Table 4).

Use of cocoa shells as an adsorbent support gave a nicotine removal of 96.9% using a single entrapment column. Subjectives were characterized as acceptable, tobacco like, slightly burnt and sweet with no mouthcoating (Run-30, Table 4).

Use of cocoa shells as the adsorbent support also permits the transfer of desirable flavor attributes from one natural substrate (cocoa shells) to another (tobacco). One may also transfer the desirable flavor subjectives from Burley tobacco to an expanded stem support.

Table 5 illustrates the results from extraction runs carried out using unwashed coarse shredded stems, unwashed fine shredded stems and washed fine shredded stems as the adsorbent support.

Combinations of stem type and shredded stem particle size were tested for extraction efficiency and product quality. Best extraction efficiency was obtained with washed fine shredded Bright stems.

Table 6 illustrates the results of a number of extraction runs carried out using washed fine shredded Bright stems.

Extraction of more than 96% of nicotine was achieved yet the product was subjectively rated as average in smoking characteristics.

Table 7 illustrates the results from extraction runs carried out utilizing 2% ammonium bicarbonate pretreatment of the tobacco filler.

The following variables were tested:

Solvent to tobacco ratio was reduced from 150 to 113 m/m, extraction time was shortened from 60 min to 45 min., and the temperature of the extraction process was lowered from 70° to 55° C. Subjectives were judged very good and nicotine extraction was high, over 96%.

Extraction of 2% ammonium bicarbonate-pretreated tobacco at 70° C., 75 m/m and for 30 minutes gave 95.2% nicotine removal (Run 51, Table 5). However, subjectives were judged not as good compared to product obtained at lower extraction temperatures.

Further reduction in extraction time (30 minutes), and further reduction of the solvent to tobacco ratio (75 m/m) at 55° C. gave reduced extraction efficiency, 94% nicotine removal (Run 57, Table 5).

Table 8 illustrates the results from extraction runs carried out using a single vessel design in the upflow and downflow modes.

In the upflow mode, the flow of carbon dioxide is in the opposite direction as the force of gravity and in the downflow mode, the flow of carbon dioxide is in the same direction as the force of gravity. The incipient fluidization velocity is about 1.1 cm/sec and the pressure drop does not become significant until up to about 1.6 cm/sec. The tobacco extraction data obtained at about 0.9 cm/sec, upflow, compared favorably with the downflow control (Run 41B vs. Run 49B, Table 8).

Table 8 also illustrates the relationship between m/m and extraction time.

The importance of the solvent to tobacco ratio was established in two experiments by varying the extraction time (from 30 min to 75 min) at a fixed m/m. The results show that a minimum solvent to tobacco ratio is needed (about 113 m/m) to achieve in excess of 96% extraction of nicotine. The time of extraction is not considered important within the range tested (Run 45-30 min.; Run 66-45 min.; Run 67-75 min.).

Tobacco materials in solution in $CO_2$, without nicotine, were collected in two runs from full flavor American blend filler (Runs 42, 43, Table 8). The tobacco was pretreated with potassium citrate to convert nicotine to its salt. The tobacco solubles were extracted with supercritical $CO_2$ at 260 atmospheres and 55° C.

The process disclosed was also used to deposit tobacco materials in solution in $CO_2$, obtained from the dry ice expanded tobacco process, as disclosed in U.S. Pat. Re No. 32,013 and 32,014 onto the tobacco filler (Run 45, Table 8).

Extensive $CO_2$ sampling during the extraction runs showed that nicotine concentration in $CO_2$ follows a first order rate of extraction.

Tables—General Notes

Al runs were carried out at about 260 atmospheres, 70° C., 25% OV (oven volatiles).

Subjective rating was based on a value of "zero" for unextracted full flavor American blend tobacco. A positive value indicates an improved rating.

All runs were carried out without extraction during the heat-up via bypass of the entrapment vessels during the fill and heat-up period.

The oven volatiles of the tobacco filler in the extraction vessel decreased when the oven volatiles of the stems were 25% and 35%. when the oven volatiles of the stems were 45% and 55%, the results were inconclusive.

Pre-drying of stems before potassium citrate treatment was not done for the following Runs (10, 25, 26, 28, 29, 31, 35 thru 39, 41 thru 47)

| KEY TO THE TABLES | |
|---|---|
| AB | 2% ammonium bicarbonate |
| ALPHA | alpha cellulose |
| CARBON | activated carbon |
| COCOA | cocoa shells with fines removed via screening |
| COT | cotton |
| CRS | cut and rolled stems |
| ETOH | ethyl alcohol |
| FF | full flavor American blend tobacco filler |
| KC | mono-potassium citrate (+n.mKC = n.m moles sprayed onto the entrapment support) |
| LS | long stems |
| LTAR | low tar blend tobacco |
| M/M | mass of carbon dioxide/mass of tobacco |
| PG | propylene glycol |
| SS | shredded stems |
| STP | strip blend tobacco |
| UCSS | unwashed coarse shredded stems |
| UFSS | unwashed fine shredded stems |
| WFSS | washed fine shredded stems |

TABLE 1

TOBACCO/CARBON RUNS

| RUN NO. | VESSEL LOADING, KG (DWB) FILLER IN EXTRACTION VESSEL [1] | ENTRAPMENT VESSEL #1 | ENTRAPMENT VESSEL #2 | CONDITIONS $CO_2$ FLOW $M^3/HR$ | TIME MINS. | M/M | % NICOTINE REMOVAL | SUB-JECTIVE RATING |
|---|---|---|---|---|---|---|---|---|
| 16 | 9 | 18 CARBON | 18 CARBON | 3.6 | 15/15 | 150 | 97.2 | −1.0 |
| 17 | 9 | 4.5 CARBON + KC[2] | N/A | 3.6 | 30 | 150 | 90.8 | −3.0 |
| 18 | 9 | 2.2 CARBON + KC | 2.2 CARBON + KC | 3.6 | 15/15 | 150 | 94.1 | −2.55 |
| 21 | 9 FF @ 12% OV | 18 CARBON | 18 CARBON | 3.6 | 15/15 | 170 | 94.4 | −2.5 |

Run no. was carried out with extraction during heatup period, in order to extract subjectives only.
1. FF: Full flavor American blend unless noted otherwise.
2. CARBON + KC: Activated carbon saturated with monopotassium citrate.

TABLE 2

TOBACCO/TREATED STEM RUNS

| RUN NO. | VESSEL LOADING, KG (DWB) FILLER IN EXTRACTION VESSEL [1] | ENTRAPMENT VESSEL #1 | ENTRAPMENT VESSEL #2 | CONDITIONS $CO_2$ FLOW $M^3/HR$ | TIME MINS. | M/M | % NICOTINE REMOVAL | SUB-JECTIVE RATING |
|---|---|---|---|---|---|---|---|---|
| 4 | 9 | 8 SS + 7.2 | 8 SS + 7.2KC | 1.8 | 30/30 | 150 | 90.0 | −2.0 |
| 5 | 9 | 8 SS + 7.2 | N/A | 1.8 | 60 | 150 | 88.3 | −2.0 (Break-through) |
| 6 | 2.25 | 8 SS + 3.6KC | N/A | 1.8 | 60 | 600 | 91.4 | −2.25 |
| 7 | 9 | 4 SS + 3.6KC | N/A | 1.8 | 60 | 150 | 78.9 | −2.0 |
| 8 | 9 | 8 SS + 13.3KC | N/A | 1.8 | 60 | 150 | 95.0 | −2.25 |
| 11 | 9 | 8 SS + 13.3KC | 8 SS + 13.3KC | 1.8 | 30/50 | 210 | 96.6 | −2.0 |
| 24 | 9* | 4 SS + 3.6KC | 4 SS + 3.6KC | 1.8 | 30/30 | 150 | 89.8 | −0.5 |
| 25 | 9 | 8 SS + 3.6KC | 8 SS + 3.6KC | 1.8 | 20/40 | 150 | 94.3 | −1.33 |
| 26 | 9 | 4 SS + 5.4KC | 4 SS + 5.4KC | 1.8 | 20/40 | 150 | 92.2 | −3.0 |
| 28 | 9 | 4 SS + 7.2KC | 4 SS + 7.2KC | 3.6 | 10/20 | 150 | 89.1 | −0.75 |
| 29 | 9* | 4 SS + 3.6KC | 4 SS + 3.6KC | 1.8 | 20/40 | 150 | 93.9 | −0.5 |
| 31 | 9 | 8 SS + 13.3KC | 8 SS + 13.3KC | 1.8 | 20/40 | 150 | 94.5 | −1.75 |
| 34 | 9 STP* | 4 SS + 3.6KC | 4 SS + 3.6KC | 1.8 | 20/40 | 150 | 82.5 | −0.33 |
| 35 | 9 LTAR* | 4 SS + 3.6KC | 4 SS + 3.6KC | 1.8 | 20/40 | 150 | 94.7 | −0.9 |
| 36 | 9* | 4 SS + 3.6KC | 4 SS + 3.6KC | 1.8 | 15/45 | 150 | 92.7 | −0.50 |
| 37 | 9* FF @ 30% OV | 4 SS + 3.6KC | 4 SS + 3.6KC | 1.8 | 15/45 | 150 | 9.28 | −0.5 |
| 38 | 9* | 4 SS + 3.6KC | 4 SS + 3.6KC | 1.8 | 15/45 | 150 | 90.4 | −1.25 |
| 41 | 9* | 4 SS + 3.6KC | 4 SS + 3.6KC | 1.8 | 15/45 | 150 | 93.7 | +0.25 |
| 42 | 9* | 4 SS + 3.6KC | 4 SS + 3.6KC | 1.8 | 15/45 | 150 | 91.8 | −0.25 |
| 43 | 9* | 4 SS + 3.6KC | 4 SS + 3.6KC | 1.8 | 15/45 | 150 | 90.8 | −0.75 |
| 44 | 9* | 4 SS + 3.6KC | 4 SS + 3.6KC | 1.8 | 15/45 | 150 | 89.6 | +.25 |
| 10 | 9 | 8 LS + 7.2KC | 8 LS + 7.2KC | 1.8 | 20/40 | 150 | 94.7 | −1.75 |
| 45 | 9 | 4 LS + 3.6KC | 4 LS + 3.6KC | 1.8 | 15/45 | 150 | 82.0 | — |
| 47 | 4 CRS + 3.6KC | 18 CARBON | 4.5 FF | 1.8 | 30/30 | 150 | 64.8 | — |

[1] FF: Full flavor american blend unless noted otherwise.
*Production runs for machine made cigarette quality evaluation.

TABLE 3

TOBACCO/TREATED TOBACCO RUNS

| RUN NO. | VESSEL LOADING, KG (DWB) FILLER IN EXTRACTION VESSEL [1] | ENTRAPMENT VESSEL #1 | ENTRAPMENT VESSEL #2 | CONDITIONS $CO_2$ FLOW $M^3$/HR | TIME MINS. | M/M | % NICOTINE REMOVAL | SUBJECTIVE RATING |
|---|---|---|---|---|---|---|---|---|
| 13 | 4.5 FF | 7.8 FF + 6.3KC | N/A | <1.8 | 45 | 175 | 83.4 | −1.5 |
| 12 | 4.5 FF | 8 FF + 72.KC | 8 FF + 7.2KC | <1.8 | 30/40 | 300 | 88.8 | −1.25 |

NOTE: Pressure drop problems in the adsorber resulted in slower $CO_2$ flow rate.

TABLE 4

TOBACCO/TREATED NON-TOBACCO MATRIX RUNS

| RUN NO. | VESSEL LOADING, KG (DWB) FILLER IN EXTRACTION VESSEL [1] | ENTRAPMENT VESSEL #1 | ENTRAPMENT VESSEL #2 | CONDITIONS $CO_2$ FLOW $M^3$/HR | TIME MINS. | M/M | % NICOTINE REMOVAL | SUBJECTIVE RATING |
|---|---|---|---|---|---|---|---|---|
| 15 | 9 FF | 9 COT + 13.3KC | 9 COT + 13.3KC | 1.8 | 30/30 | 150 | 92.8 | −4.0 |
| 27 | 9 FF | 7.5 COT + 13.3KC | 7.5 COT + 13.3KC | 1.8 | 20/40 | 150 | 91.1 | −0.75 |
| 32 | 4.5 FF 4.5 ALPHA +7.2KC | N/A | N/A | 1.8 | 30 | 150 | 79.8 | −3.5 |
| 30 | 4.5 FF 4.5 COCOA +7.2KC | N/A | N/A | 1.8 | 30 | 150 | 96.9 | −0.5 |
| 40 | 4.5 FF 4.5 COCOA +3.6KC | N/A | N/A | 1.8 | 30 | 150 | 92.1 | −0.6 |

TABLE 5

SHREDDED STEMS RUNS

| RUN NO. | VESSEL LOADING, KG (DWB) EXTRACTION VESSEL | ENTRAPMENT VESSEL 1 | ENTRAPMENT VESSEL 2 | CONDITIONS TIME, MIN. $ENT_2/ENT_2$ | $CO_2$ FLOW KG/MIN | M/M | TEMP °C. | % NICO. RE-MOVAL | SUBJ. RAT-ING |
|---|---|---|---|---|---|---|---|---|---|
| 01 | 9FF | 6FF | 6FF | 30/30 | 0 TO 30 | — | 70 | — | — |
| 02 | 9 FF | 4 UCSS + 3.6KC | 4 UCSS + 3.6KC | 15/45 | 22.5 | 150 | 70 | 94 | −0.8 |
| 04 | 9 FF | 3 UFSS + 2.7KC & 1 WFSS + 0.9KC | 3 UFSS + 2.7KC & 1 WFSS + 0.9KC | 15/45 | 22.5 | 150 | 70 | 93 | −0.5 |
| 05 | 9 FF | 4 UFSS | 4 UFSS | 15/45 | 22.5 | 150 | 70 | 92 | −0.5 |
| 06 | 9 FF | 4 UFSS + 3.6KC | 4 UFSS + 3.6KC | 15/45 | 22.5 | 150 | 70 | 93 | −0.4 |
| 51 | 9 FF + AB | 4 WFSS + 3.6KC | 4 WFSS + 3.6KC | 8/22 | 22.5 | 75 | 70 | 95 | −0.7 |
| 57 | 9 FF + AB | 4 WFSS + 3.6KC | 4 WFSS + 3.6KC | 8/22 | 22.5 | 75 | 55 | 94 | +0.4 |

NOTES:
1. RUN 01: DOWNFLOW IN ENTRAPMENT VESSEL 1, UPFLOW IN ENTRAPMENT VESSEL 2.
2. M/M IS FOR EXTRACTION CONDITIONS ONLY - EXTRACTION VESSEL FILL AND HEATUP ARE NOT INCLUDED.

TABLE 6

WASHED FINE SHREDDED STEMS RUNS

| RUN NO. | VESSEL LOADING, KG (DWB) EXTRACTION VESSEL | ENTRAPMENT VESSEL 1 | ENTRAPMENT VESSEL 2 | CONDITIONS TIME, MIN. $ENT_2/ENT_2$ | $CO_2$ FLOW KG/MIN | M/M | TEMP °C. | % NICO. RE-MOVAL | SUBJ. RAT-ING |
|---|---|---|---|---|---|---|---|---|---|
| 03 | 9 FF | 4 WFSS + 3.6KC | 4 WFSS + 3.6KC | 15/45 | 22.5 | 150 | 70 | 95 | −0.5 |
| 07 | 9 FF | 4 WFSS + 3.6KC | 4 WFSS + 3.6KC | 15/45 | 22.5 | 150 | 70 | 97 | −0.8 |
| 08 | 9 FF | 4 WFSS + 3.6 KC | 4 WFSS + 3.6KC | 15/45 | 22.5 | 150 | 70 | 97 | −0.5 |
| 09 | 9 FF | 4 WFSS + 3.6KC | 4 WFS + 3.6KC | 15/45 | 22.5 | 150 | 70 | 95 | −0.8 |
| 11 | 9 FF | 4 WFSS + 3.6KC | 4 WFSS + 3.6KC | 15/45 | 22.5 | 150 | 70 | 97 | −0.2 |
| 12 | 9 FF | 4 WFSS + 3.6KC | 4 WFSS + 3.6KC | 15/45 | 22.5 | 150 | 70 | 96 | −0.6 |
| 13 | 9 FF | 4 WFSS + | 4 WFSS + | 15/45 | 22.5 | 150 | 70 | 97 | −0.4 |

TABLE 6-continued

| WASHED FINE SHREDDED STEMS RUNS | | | | | | | | | |
|---|---|---|---|---|---|---|---|---|---|
| | VESSEL LOADING, KG (DWB) | | | CONDITIONS | | | | % NICO. | SUBJ. |
| RUN NO. | EXTRACTION VESSEL | ENTRAPMENT VESSEL 1 | ENTRAPMENT VESSEL 2 | TIME, MIN. $ENT_2/ENT_2$ | $CO_2$ FLOW KG/MIN | M/M | TEMP °C. | RE-MOVAL | RAT--ING |
| 14 | 9 FF | 3.6KC 4 WFSS + 3.6KC | 3.6KC 2 WFSS + 3.6KC | 15/45 | 22.5 | 150 | 70 | 96 | −0.8 |
| | | | | | | | AVERAGE = 96 | | −0.6 |

TABLE 7

| AMMONIUM BICARBONATE RUNS | | | | | | | | | |
|---|---|---|---|---|---|---|---|---|---|
| | VESSEL LOADING, KG (DWB) | | | CONDITIONS | | | | % NICO. | SUBJ. |
| RUN NO. | EXTRACTION VESSEL | ENTRAPMENT VESSEL 1 | ENTRAPMENT VESSEL 2 | TIME, MIN. $ENT_2/ENT_2$ | $CO_2$ FLOW KG/MIN | M/M | TEMP °C. | RE-MOVAL | RAT--ING |
| 10 | 9 FF +AB | 4 WFSS + 3.6KC | 4 WFSS + 3.6KC | 15/45 | 22.5 | 150 | 55 | 97 | −0.1 |
| 15 | 9 FF + AB | 4 WFSS + 3.6KC | 4 WFSS + 3.6KC | 15/45 | 22.5 | 150 | 55 | 97 | +0.4 |
| 27 | 9 FF + AB | 4 WFSS + 3.6KC | 4 WFSS + 3.6KC | 15/45 | 22.5 | 150 | 55 | 97 | +0.3 |
| 28 | 9 FF + AB | 4 WFSS + 3.6KC | 4 WFSS + 3.6KC | 15/45 | 22.5 | 150 | 55 | 97 | +0.2 |
| 29 | 9 FF + AB | 4 WFSS + 3.6KC | 4 WFSS + 3.6KC | 15/45 | 22.5 | 150 | 55 | 97 | +0.5 |
| 30 | 9 FF + AB | 4 WFSS + 3.6KC | 4 WFSS + 3.6KC | 15/45 | 22.5 | 150 | 55 | 97 | +0.4 |
| 31 | 9 FF +AB | 4 WFSS + 3.6KC | 4 WFSS + 3.6KC | 15/45 | 22.5 | 150 | 55 | 97 | +0.5 |
| 32 | 9 FF + AB | 4 WFSS + 3.6KC | 4 WFSS + 3.6KC | 15/45 | 22.5 | 150 | 55 | 96 | +0.5 |
| 33 | 9 FF + AB | 4 WFSS + 3.6KC | 4 WFSS + 3.6KC | 15/45 | 22.5 | 150 | 55 | 98 | +0.7 |
| 34 | 9 FF + AB | 4 WFSS + 3.6KC | 4 WFSS + 3.6KC | 15/45 | 22.5 | 150 | 55 | 97 | +0.3 |
| 52 | 9 FF + AB | 4 WFSS + 3.6KC | 4 WFSS + 3.6KC | 11/34 | 22.5 | 113 | 66 | 97 | +0.5 |
| 53 | 9 FF + AB | 4 WFSS + 3.6KC | 4 WFSS + 3.6KC | 11/34 | 22.5 | 113 | 55 | 97 | +0.6 |
| 54 | 9 FF + AB | 4 WFSS + 3.6KC | 4 WFSS + 3.6KC | 11/34 | 22.5 | 113 | 55 | 95 | +0.7 |
| 55 | 9 FF + AB | 4 WFSS + 3.6KC | 4 WFSS + 3.6KC | 11/34 | 22.5 | 113 | 55 | 96 | +0.7 |
| 56 | 9 FF + AB | 4 WFSS + 3.6KC | 4 WFSS + 3.6KC | 11/34 | 22.5 | 113 | 55 | 96 | +0.5 |
| 58 | 9 FF + AB | 4 WFSS + 3.6KC | 4 WFSS + 3.6KC | 11/34 | 22.5 | 113 | 55 | 96 | +0.4 |
| 59 | 9 FF + AB | 4 WFSS + 3.6KC | 4 WFSS + 3.6KC | 11/34 | 22.5 | 113 | 55 | 97 | +0.5 |
| 60 | 9 FF + AB | 4 WFSS + 3.6KC | 4 WFSS + 3.6KC | 11/34 | 22.5 | 113 | 55 | 97 | +0.5 |
| 61 | 9 FF + AB | 4 WFSS + 3.6KC | 4 WFSS + 3.6KC | 11/34 | 22.5 | 113 | 55 | 97 | +0.5 |
| 62 | 9 FF + AB | 4 WFSS + 3.6KC | 4 WFSS + 3.6KC | 11/34 | 22.5 | 113 | 55 | 98 | +0.5 |
| 63 | 9 FF + AB | 4 WFSS + 3.6KC | 4 WFSS + 3.6KC | 11/34 | 22.5 | 113 | 55 | 97 | +0.4 |
| 64 | 9 FF + AB | 4 WFSS + 3.6KC | 4 WFSS + 3.6KC | 11/34 | 22.5 | 113 | 55 | 96 | +0.4 |
| 65 | 9 FF + AB | 4 WFSS + 3.6KC | 4 WFSS + 3.6KC | 11/34 | 22.5 | 113 | 55 | 97 | +0.4 |
| 66 | 9 FF + AB | 4 WFSS + 3.6KC | 4 WFSS + 3.6KC | 11/34 | 22.5 | 113 | 55 | 97 | +0.4 |
| 67 | 9 FF + AB | 4 WFSS + 3.6KC | 4 WFSS + 3.6KC | 19/56 | 13.5 | 113 | 55 | 97 | +0.5 |
| | | | | | | | AVERAGE = 97 | | +0.5 |

TABLE 8

| EXPERIMENTAL RUNS | | | | | | | | | |
|---|---|---|---|---|---|---|---|---|---|
| FLAVOR ADDBACK: | | | | | | | | | |
| | VESSEL LOADING, KG (DWB) | | | CONDITIONS | | | | | |
| RUN NO. | EXTRACTION VESSEL | EN-TRAPMENT VESSEL 1 | EN-TRAPMENT VESSEL 2 | TIME, MIN. $ENT_1/ENT_2$ | $CO_2$ FLOW KG/MIN | M/M | TEMP °C. | % NICO. REMOVAL | SUBJ. RATING |
| 45 | 9 FF + AB | 4 WFSS + 3.6KC + FLAVOR | 4 WFSS + 3.6KC + FLAVOR | 8/22 | 34 | 113 | 55 | 96 | — |

TABLE 8-continued

EXPERIMENTAL RUNS

SOLUBLES COLLECTION:

| RUN NO. | VESSEL LOADING, KG (DWB) EXTRACTION VESSEL | ENTRAPMENT VESSEL 1 | ENTRAPMENT VESSEL 2 | CONDITIONS TIME, MIN. $ENT_1/ENT_2$ | $CO_2$ FLOW KG/MIN | TEMP °C. | SOLVENT |
|---|---|---|---|---|---|---|---|
| 42 | 9 FF + 7.2KC | 12 FF + 9.6KC | 12 FF + | 3.5 HRS | 22.5 | 55 | PG |
| 43 | 9 FF + 7.2KC | 12 FF + 9.6KC | 12 F 9.6KC | 1.8 HRS | 22.5 | 55 | ETOH |

SINGLE VESSEL DESING: DOWNFLOW AND UPFLOW

| RUN NO. | VESSEL LOADING, KG (DWB) EXTRACTION VESSEL | EN-TRAPMENT VESSEL 1 | EN-TRAPMENT VESSEL 2 | CONDITIONS TIME, MIN. $ENT_1/ENT_2$ | $CO_2$ FLOW KG/MIN | VELO-CITY CM/SEC | M/M | TEMP °C. | % NICO. RE-MOVAL | SUBJ. RAT-ING |
|---|---|---|---|---|---|---|---|---|---|---|
| 41A | 3.4 FF + AB + 3 WFSS + 2.7KC | | | 30 | 14 | 0.9 DOWN | 106 | 55 | 86 | — |
| 41B | | 4.5 FF + AB + 4 WFSS + 3.6KC | | 30 | 14 | 0.9 DOWN | 157 | 55 | 96 | +0.1 |
| 41C | | | 4.5 FF + AB + 4 WFSS + 3.6KC | 30 | 14 | 0.9 DOWN | 180 | 55 | 96 | 0 |
| 49A | 3.4 FF + AB 3 WFSS + 2.7KC | | | 30 | 14 | 0.9 DOWN | 125 | 55 | 93 | — |
| 49B | | 4.5 FF + AB 4 WFSS + 3.6KC | | 30 | 14 | 0.9 UP | 157 | 55 | 97 | — |
| 49C | | | 4.5 FF + AB 4 WFSS + 3.6KC | 30 | 20 | 1.3 UP | 157 | 55 | 94 | — |

NOTE: 1. TOBACCO FILLER AND SHREDDED STEMS WERE IN THE SAME VESSEL IN RUNS 41 AND 49. THEREFORE THE N/N/ REPORTED FOR RUNS 41 AND 49 INCLUDES THE MASS OF $CO_2$ DURING THE FILL AND HEATUP PERIOD.

The following examples are illustrative.

EXAMPLE 1

Each of the entrapment vessels 2 and 3 in FIG. 1 was loaded with 2.2 kg of cotton cloth which were impregnated with 2 liters of an aqueous solution containing 920.8g monopotassium citrate. 12 Kg of full flavor American blend cigarette filler tobacco (25% OV) was placed in extraction vessel 1.

With the valves to the entrapment vessels closed, the supercritical $CO_2$ was brought to 70° C. and 260 bar. Then the valve to the first trap was opened and the stream of supercritical $CO_2$ was circulated through the extractor and the first trap for 15 minutes. At the end of this time, the valve to the second trap was opened and the valve to the first trap was closed. The flow of supercritical $CO_2$ was circulated to the second trap for an additional period of 15 min. At the completion of 30 minutes total extraction time, the circulation was stopped and the $CO_2$ was removed from the system. Tobacco blend and entrapment materials were removed from the system and submitted for nicotine analysis. A reduction in nicotine content of the tobacco blend of 77.4% was obtained. The tobacco blend retained a strong characteristic aroma which was not different from the unextracted blend.

Upon smoking, similar tobacco impact was obtained compared with unextracted tobacco.

EXAMPLE 2

4.4 Kg of expanded bright tobacco stems were impregnated with 1.78 1 of aqueous monopotassium citrate to yield a moistened stem support containing 409.8 g of monopotassium citrate. This entrapment support was placed in the bottom portion of extraction vessel 1. A porous plate was placed on top of the entrapment material and 3.52 kg of burley tobacco 25% OV) was loaded into the extractor vessel. The entrapment vessels 2 and 3 in FIG. 1 were removed from the flow system by valve adjustment. A stream of supercritical $CO_2$ was circulated through the extractor with the temperature and pressure brought to 70° C. and 260 atmospheres, respectively. After minutes extraction time, the circulation was stopped and the $CO_2$ was removed from the system. Tobacco product (burley) and entrapment material (expanded stems) were removed and submitted for nicotine analysis. The burley tobacco product had a reduction in nicotine content of 92.4%. Analysis of the expanded stem entrapment material yielded a corresponding increase in nicotine content. The burley tobacco product retained a strong characteristic aroma which was not different subjectively from the unextracted burley tobacco.

Upon smoking the extracted burley tobacco, similar tobacco impact was obtained compared with the tobacco impact from unextracted tobacco.

We claim:

1. A method for the selective removal of basic components from a solvent in an extraction process, which basic components are among a plurality of substances extracted from a material by the solvent during one or more cycles of the extraction process, which extraction process comprises contacting the material to be extracted with the solvent at high pressure and in a physical state which is either a liquid at a pressure of from about 50–300 atmospheres or a supercritical fluid at a temperature from the critical temperature of the solvent to about 120° C. at a pressure of from about 70 to 1500 atmospheres, and a means of removing substances from the solvent, said method comprising a single means of removing substances from the solvent comprising contacting the solvent with a non-volatile acid which acid is not soluble in the extraction solvent, directly following the contact of the solvent with the material to be extracted, while maintaining the solvent in the same physical state it was in prior to contact with the acid.

2. The method according to claim 1 wherein the basic component is nicotine.

3. The method according to claim 1 wherein the acid is selected from the group consisting of polycarboxylic acids and the monovalent salts thereof.

4. The method according to claim 3 wherein the acid is monopotassium citric acid.

5. The method according to claim 1 wherein the extraction solvent is selected from the group consisting of carbon dioxide, argon, $SF_6$, $N_2O$, lower halogenated hydrocarbons and lower hydrocarbons.

6. The method according to claim 5 wherein the extraction solvent is carbon dioxide.

7. The method according to claim 1 wherein the non-volatile acid is dissolved or suspended in water, acid, aqueous acid or aqueous salt solution.

8. The method according to claim 7 wherein the non-volatile acid is monopotassium citrate.

9. The method according to claim 1 wherein the acid is contained on a support medium.

10. The method according to claim 9 wherein the support medium is cotton cloth.

11. The method according to claim 9 wherein the support medium is carbon.

12. The method according to claim 9 wherein the support medium is cellulose.

13. The method according to claim 9 wherein the support medium is tobacco filler.

14. The method according to claim 9 wherein the support medium is tobacco stems.

15. The method according to claim 14 wherein the tobacco stems are long stems, cut and rolled, shredded, expanded, treated or untreated stems.

16. The method according to claim 9 wherein the acid is selected from the group consisting of polycarboxylic acids and the monovalent salts thereof.

17. The method according to claim 16 wherein the acid is monopotassium citric acid.

18. In a method for the selective extraction of nicotine from tobacco, preserving aroma-producing components, using normally gaseous solvents at high pressure, said method characterized in that basic components are among a plurality of substances extracted from tobacco by a solvent during one or more cycles of an extraction process, said method further characterized in that the tobacco is extracted with the solvent at high pressure in the presence of at least 10% by weight of moisture, based on the weight of the tobacco, the solvent at high pressure being in a physical state which is either a liquid at a pressure of from 50 to 300 atmospheres or a supercritical fluid at a temperature from the critical temperature of the solvent to about 120° C. at a pressure of from about 70 to 1500 atmospheres, the improvement which comprises contacting the solvent with a non-volatile acid which is not soluble in the extraction solvent, while maintaining the solvent in the same physical state it was in prior to contact with the acid as the single means of removing substances from the solvent, which single means selectively removes nicotine from the solvent.

19. The method according to claim 18 wherein the moisture content of the tobacco is up to about 30% by weight.

20. The method according to claim 18 wherein the extraction solvent is selected from the group consisting of carbon dioxide, argon, $SF_6$, $N_2O$, lower halogenated hydrocarbons and lower hydrocarbons.

21. The method according to claim 18 wherein the acid is selected from the group consisting of polycarboxylic acids and the monovalent salts thereof.

22. The method according to claim 21 wherein the acid is monopotassium citrate.

23. The method according to claim 18 wherein the said non-volatile acid is dissolved or suspended in water, acid, aqueous acid or aqueous salt solution.

24. The method according to claim 23 wherein the non-volatile acid is selected from the group consisting of polycarboxylic acids and the monovalent salts thereof.

25. The method according to claim 24 wherein the non-volatile acid is monopotassium citrate.

26. The method according to claim 18 wherein the acid is contained on a support medium.

27. The method according to claim 26 wherein the support medium is selected from the group consisting of cotton cloth, tobacco stems, carbon, cellulose and tobacco filler.

28. The method according to claim 27 wherein the support medium is tobacco stems which are long stems, cut and rolled, shredded, expanded, treated or untreated stems.

29. The method according to claim 26 wherein the acid is selected from the group consisting of polycarboxylic acids and the monovalent salts thereof.

30. The method according to claim 29 wherein the acid is monopotassium citrate.

31. A method for the selective removal of basic components from plant products containing a plurality of substances including acid salt forms of said basic components, said method comprising first contacting a plant product with a chemical base which does not substantially react under ambient conditions with the acid salt forms of said basic components or with other plant components but are nonetheless effective in increasing the amount of nicotine which can be extracted, then contacting the plant product with an extraction solvent at high pressure, said solvent at high pressure being in a physical state which is either a liquid at a pressure of from about 50 to 300 atmospheres or a supercritical fluid at a temperature from the critical temperature of the solvent to about 112° C. at a pressure of from about 70 to 1500 atmospheres.

32. The method according to claim 31 wherein one of the basic components in the plant product is nicotine.

33. The method according to claim 31 wherein the extraction solvent is selected from the group consisting of carbon dioxide, argon, $SF_6$, $N_2O$, lower halogenated hydrocarbons and lower hydrocarbons.

34. The method according to claim 33 wherein the extraction solvent is carbon dioxide.

35. The method according to claim 31 wherein the chemical base has a $pK_a$ greater than about 7.2 and less that about 10.

36. The method according to claim 31 wherein the chemical base is selected from the group consisting of ammonium bicarbonate, glycosylamines, N-glycosides of aldoses and N-glycosides of ketoses.

37. The method according to claim 31 wherein the chemical base is selected from the group consisting of sodium carbonate, sodium bicarbonate, potassium carbonate, potassium bicarbonate, ammonia, aqueous ammonia, triethylamine and trimethylamine.

38. The method according to claim 31 wherein the extraction solvent is further contacted with a non-volatile acid which is not soluble in the extraction solvent while maintaining the extraction solvent in the same physical state it was in prior to contact with the acid.

39. The method according to claim 38 wherein the acid is selected from the group consisting of polycarboxylic acids and the monovalent salts thereof.

40. The method according to claim 39 wherein the acid is monopotassium citric acid.

41. The method according to claim 38 wherein the non-volatile acid is dissolved or suspended in water, acid, aqueous acid or aqueous salt solution.

42. The method according to claim 41 wherein the non-volatile acid is monopotassium citrate.

43. The method according to claim 38 wherein the acid is contained on a support medium.

44. The method according to claim 43 wherein the support medium is selected from the group consisting of cotton cloth, tobacco stems, carbon, cellulose, and tobacco filler.

45. The method according to claim 44 wherein the support medium is tobacco stems which are long stems, cut and rolled, shredded, expanded, treated or untreated stems.

46. In a method for the selective extraction of nicotine from tobacco, preserving aroma-producing components, using normally gaseous solvents at high pressure, said method characterized in that the tobacco is extracted with the solvent at high pressure in the presence of at least 10% by weight of moisture based on the weight of the tobacco, said solvent at high pressure being in a physical state which is either a liquid at a pressure of from about 50 to 300 atmospheres or a supercritical fluid at a temperature from the critical temperature of the solvent to about 112° C. at a pressure of from about 70 to 1500 atmospheres, the improvement which comprises pretreating the tobacco with a chemical base which does not significantly react with tobacco components under ambient conditions but are nonetheless effective in increasing the amount of nicotine which can be extracted.

47. The method according to claim 46 wherein the moisture content of the tobacco is up to about 30% by weight.

48. The method according to claim 46 wherein the extraction solvent is selected from the group consisting of carbon dioxide, argon, $SF_6$, $NO_2$, lower halogenated hydrocarbons and lower hydrocarbons.

49. The method according to claim 48 wherein the extraction solvent is carbon dioxide.

50. The method according to claim 46 wherein the chemical base has a $pK_a$ greater than about 7.2 and less that about 10.

51. The method according to claim 46 wherein the chemical base is selected from the groups consisting of ammonium bicarbonate, glycosylamines, N-glycosides of aldoses and N-glycosides of ketoses.

52. The method according to claim 46 wherein the chemical base is selected from the group consisting of sodium carbonate, sodium bicarbonate, potassium carbonate, potassium bicarbonate, ammonia, aqueous ammonia, triethylamine and trimethylamine.

53. The method according to claim 46 wherein the extraction solvent is further contacted with a non-volatile acid which is not soluble in the extraction medium while maintaining the extraction solvent in the same physical state it was in prior to contact with the acid.

54. The method according to claim 53 wherein the acid is selected from the group consisting of polycarboxylic acids and the monovalent salts thereof.

55. The method according to claim 54 wherein the acid is monopotassium citric acid.

56. The method according to claim 53 wherein the said non-volatile acid is dissolved or suspended in water, acid, aqueous acid or aqueous salt solution.

57. The method according to claim 56 wherein the non-volatile acid is monopotassium citrate.

58. The method according to claim 53 wherein the acid is contained on a support medium.

59. The method according to claim 58 wherein the support medium is selected from the group consisting of cotton cloth, tobacco stems, carbon, cellulose, and tobacco filler.

60. The method according to claim 59 wherein the support medium is tobacco stems which can be long stems, cut and rolled, shredded, expanded, treated or untreated stems.

* * * * *